US008966760B2

(12) United States Patent
Singer et al.

(10) Patent No.: US 8,966,760 B2
(45) Date of Patent: Mar. 3, 2015

(54) METHOD OF MANUFACTURING A POSITIVE DISPLACEMENT INJECTION PUMP

(75) Inventors: Rusty Singer, New Orleans, LA (US); Andrew C. Elliot, Covington, LA (US)

(73) Assignee: Checkpoint Fluidic Systems International, Ltd., Mandeville, LA (US)

( * ) Notice: Subject to any disclaimer, the term of this patent is extended or adjusted under 35 U.S.C. 154(b) by 283 days.

(21) Appl. No.: 13/307,928

(22) Filed: Nov. 30, 2011

(65) Prior Publication Data

US 2012/0079718 A1 Apr. 5, 2012

Related U.S. Application Data

(62) Division of application No. 12/104,883, filed on Apr. 17, 2008, now Pat. No. 8,087,345.

(60) Provisional application No. 60/914,559, filed on Apr. 27, 2007.

(51) Int. Cl.

| | |
|---|---|
| ***B21D 51/16*** | (2006.01) |
| ***F01L 1/46*** | (2006.01) |
| ***F04B 9/105*** | (2006.01) |
| *F01L 3/00* | (2006.01) |

(52) U.S. Cl.

CPC ..... *F04B 9/105* (2013.01); *F01L 2003/25* (2013.01); *F01L 1/46* (2013.01); *F01L 2103/00* (2013.01)

USPC ..... 29/890.12

(58) Field of Classification Search

CPC .... F01L 25/063; F01L 2103/00; F04B 9/105; F04B 9/125

USPC ..... 29/890.12, 890.122, 890.132

See application file for complete search history.

(56) References Cited

U.S. PATENT DOCUMENTS

| | | | |
|---|---|---|---|
| 151,667 | A | 6/1874 | Loretz |
| 635,537 | A | 10/1899 | Gasz |
| 923,486 | A | 6/1909 | Bowen |
| 2,745,387 | A | 5/1956 | Dinkelkamp |

(Continued)

FOREIGN PATENT DOCUMENTS

| | | | |
|---|---|---|---|
| DE | 2626954 | A1 | 1/1978 |
| DE | 2660470 | C2 | 6/1984 |

(Continued)

OTHER PUBLICATIONS

Oct. 22, 2008, Search Report & PCT Written Opinion in PCT/US2008/061619.

(Continued)

*Primary Examiner* — Dave Bryant
*Assistant Examiner* — Moshe Wilensky
(74) *Attorney, Agent, or Firm* — Jones Walker, LLP

(57) ABSTRACT

A reciprocating drive mechanism having a housing with upper and lower internal chambers with a spool slidably positioned inside the upper internal chamber. There is at least one fluid inlet and fluid exhaust communicating with the upper internal chamber and at least one slide valve positioned within the upper internal chamber and traveling with the spool. A piston positioned in the lower internal chamber divides the lower internal chamber into an upper and lower cylinder space. A valve stem is connected to the piston and includes a bore communicating with the upper internal chamber and an exhaust passage is positioned between the upper and lower internal chambers.

8 Claims, 12 Drawing Sheets

(56) References Cited

U.S. PATENT DOCUMENTS

| | | | |
|---|---|---|---|
| 3,374,713 | A | 3/1968 | Broughton |
| 3,800,665 | A | 4/1974 | Von Ruden |
| 4,062,639 | A | 12/1977 | Conlee |
| 4,104,008 | A | 8/1978 | Hoffmann et al. |
| 4,161,308 | A | 7/1979 | Bell et al. |
| 4,224,013 | A | 9/1980 | Davis |
| 4,280,396 | A | 7/1981 | Zeuner et al. |
| 4,593,712 | A | 6/1986 | Quartana, III |
| 4,776,773 | A | 10/1988 | Quartana, III |
| 5,002,469 | A | 3/1991 | Murata et al. |
| 5,004,015 | A | 4/1991 | Amrhein et al. |
| 5,173,036 | A | 12/1992 | Fladby |
| 5,299,598 | A | 4/1994 | Quartana, III et al. |
| 5,468,127 | A | 11/1995 | Elliott et al. |
| 5,836,020 | A | 11/1998 | Morris |
| 6,183,217 | B1 | 2/2001 | Elliott et al. |
| 6,736,046 | B2 | 5/2004 | Elliott et al. |
| 2008/0267795 | A1 | 10/2008 | Singer et al. |

FOREIGN PATENT DOCUMENTS

| | | | |
|---|---|---|---|
| FR | 2355180 | A1 | 1/1978 |
| GB | 211837 | A | 9/1924 |
| GB | 440689 | A | 1/1936 |

OTHER PUBLICATIONS

Letter Regarding Claim Amendments; PCT/US2008/061619; Feb. 25, 2009.

International Preliminary Examination Report; PCT/US2008/061619; Jun. 26, 2009.

SECTION BB-BB

SECTION DD-DD

SECTION CC-CC

METHOD OF MANUFACTURING A POSITIVE DISPLACEMENT INJECTION PUMP

This application is a divisional of U.S. application Ser. No. 12/104,883, filed on Apr. 17, 2008, which claims the benefit under 35 USC §119(e) of U.S. Provisional Application no. 60/914,559 filed Apr. 27, 2007, both of which are incorporated by reference herein in their entirety.

FIELD OF INVENTION

The present invention relates to reciprocating drive mechanisms and control valves for the same. Particular embodiments relate to pilot valves for controlling reciprocating tools, such as reciprocating pumps.

BACKGROUND OF INVENTION

There are various prior art devices known for controlling reciprocating pumps. Many prior art devices use a mechanical control mechanism to drive the piston of the reciprocating pump, but these mechanisms have been unreliable either because they require a number of failure- and/or wear-prone components or because they can stall or vary in stroke frequency in response to varying operating conditions frequently encountered in practical usage.

The pilot control valve disclosed in U.S. Pat. No. 6,183,217 B1 changes the directional flow of control fluid to a piston coupled to the pilot control valve to drive a reciprocating device. U.S. Pat. No. 6,183,217 B1 attempts to improve reliability by controlling the communication of control fluid to a piston included with a reciprocating device using pneumatic valve control rather than a mechanical control mechanism. U.S. Pat. No. 6,736,046 utilizes a slide valve member shiftable within a valve body between a first or "downstroke" position and a second or "upstroke" position. When in its first position, slide valves allow communication of control fluid supplied to the valve body to the lower surface of the piston. As the slide valves move to their second position, they allow communication of pressurized control fluid to the upper surface of the piston causing the piston to return to its first position. Nevertheless, there remain advantages in providing new reciprocating devices which offer still further improvements.

SUMMARY OF SELECTED EMBODIMENTS

One embodiment of the present invention is a reciprocating drive mechanism having a housing with upper and lower internal chambers. A spool is slidably positioned inside the upper internal chamber and at least one fluid inlet and fluid exhaust communicates with the upper internal chamber. At least one slide valve is positioned within the upper internal chamber and travels with the spool. A piston is positioned in the lower internal chamber and divides the lower internal chamber into an upper and lower cylinder space. There is further at least one fluid conduit communicating between the upper internal chamber and an upper cylinder space and at least one fluid conduit communicating between the upper internal chamber and a lower cylinder space. A valve stem is connected to the piston and includes a bore communicating with the upper internal chamber. There are two side passages formed in the valve stem: a first side passage connecting to a center bore in the valve stem; and a second side passage formed by second and third bores in the valve stem, resulting in the second side passage being spaced vertically apart from the first side passage; and the second and third bores spaced vertically apart from one another and fluidly connected with one another.

Another embodiment is a reciprocating drive mechanism having a housing with upper and lower internal chambers. A spool is slidably positioned inside the upper internal chamber and the spool has an internal passage which is less than the length of the spool. There is at least one fluid inlet and fluid exhaust communicating with the upper internal chamber and at least one slide valve positioned within the upper internal chamber travels with the spool. A piston is positioned in the lower internal chamber and divides the lower internal chamber into an upper and lower cylinder space. There is further at least one fluid conduit communicating between the upper internal chamber and the upper cylinder space and at least one fluid conduit communicating between the upper internal chamber and the lower cylinder space. A valve stem is connected to the piston, extends into the upper internal chamber, and has first and second side passages formed therein.

DETAILED DESCRIPTION OF SELECTED EMBODIMENTS

Figure 1A:
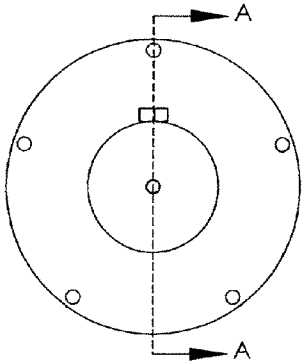
FIGS. 1A to 1D are top views of one embodiment illustrating where various cross-sections are taken in the following figures.
Figure 1B:
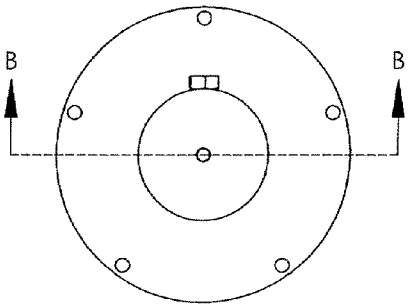
Figure 1D:
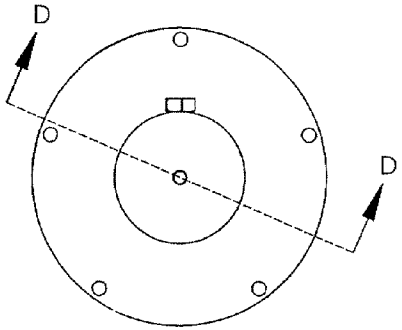
Figure 1C:
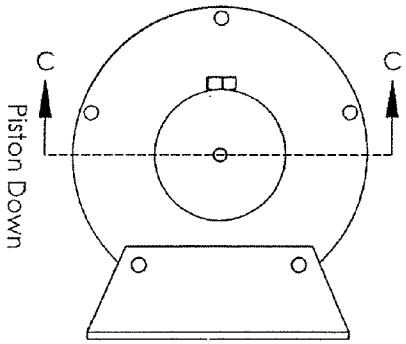
Figure 2:
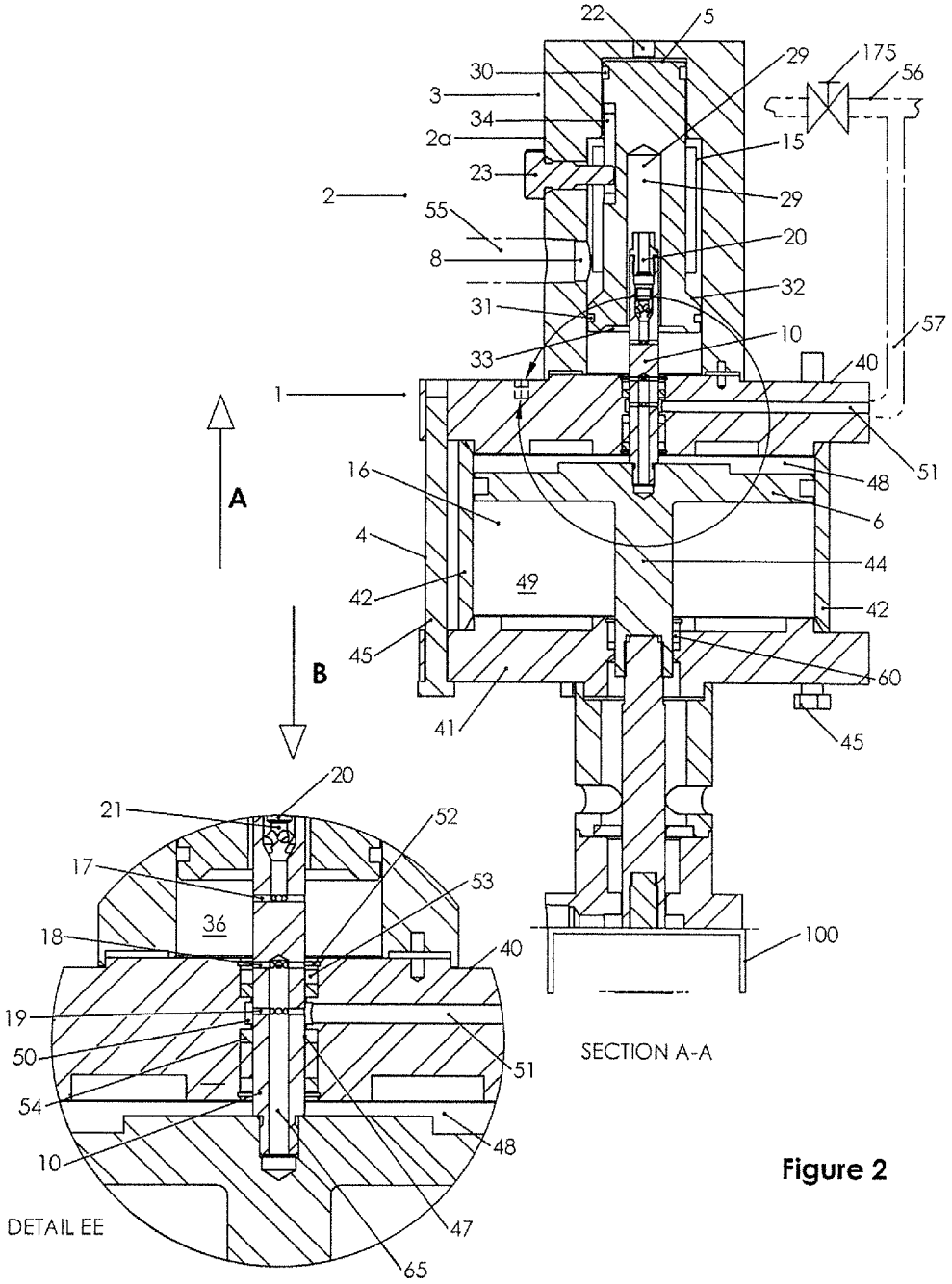
FIG. 2 is a cross-section along line A-A seen in FIG. 1A.

FIGS. 2-7 illustrate one embodiment of the reciprocating drive mechanism of the present invention. FIG. 2 shows a cross-section of this embodiment of drive mechanism 1 taken along the section line A-A seen in FIG. 1A. The drive mechanism 1 generally comprises a housing 2 which includes an upper internal chamber 15 and a lower internal chamber 16. In this particular embodiment, the upper internal chamber 15 forms part of a pilot valve 3 and the lower internal chamber 16 forms part of a piston and cylinder assembly or drive assembly 4. A reciprocating tool 100 is attached to and powered by drive mechanism 1. A driving fluid supply line 55 and a fluid exhaust line 56 (see FIG. 3) communicate with pilot valve 3.

Nonlimiting examples of reciprocating tools 100 may include a single or double-acting liquid pumps utilizing a reciprocating plunger, diaphragm, or bellows. In one embodiment, the pilot valve 3 drives piston and cylinder assembly 4 using compressible, non-compressible, or dual-phase pressurized control fluid. The control fluid is typically a liquid or gas or some combination of both and will depend on the nature of the application. In certain embodiments, the control fluid may be air and is generally maintained at a pressure ranging anywhere from about 20 psi to about 1,500 psi (or any range therebetween) or more commonly between about 45 psi to about 250 psi, but higher or lower pressures are well within the scope of the invention depending on seals and piston materials employed. As further described below, the illustrated embodiment of pilot valve 3 achieves a continuous and consistent pumping rate for the reciprocating device 100 using only pneumatic valve control.

Viewing FIG. 2, it can be seen this embodiment of pilot valve 3 includes valve housing 2*a* with the upper internal chamber 15 formed therein. Fluid inlet 8 connecting to fluid supply line 55 and exhaust outlet 9 (see FIG. 3) connecting to exhaust line 56 will be formed in housing 2*a*. In certain embodiments, the exhaust will be to atmospheric pressure. However, there may be embodiments where the exhaust is to a pressure greater or lesser than atmospheric. Generally, the exhaust pressure should be sufficiently less than the inlet fluid pressure so the reciprocating drive mechanism may operate at the desired efficiency. The embodiment of FIG. 3 also illustrates variable orifice 175 which allows the velocity of drive fluid escaping from exhaust lines 56 to be regulated, thus controlling the speed of the reciprocating action of the drive mechanism. It will be understood that other ways of controlling the speed of the reciprocating mechanism exist, including the insertion of a variable orifice anywhere within fluid conduits 11 or 12. There is further a top aperture 22 in housing 2*a* which may communicate with the atmosphere or alternatively connect to exhaust line 56. In alternate embodiments top aperture 22 may be eliminated by increasing the "dead volume" located above spool 5, as long as this dead volume is sufficient in size to maintain the pressure therein at a magnitude significantly less than the pressure at the fluid inlet.

Still viewing FIG. 2, positioned within upper internal chamber 15 is spool 5 which has upper seal 30 and lower seal 31. In this embodiment, seals 30 and 31 are annular cup seals set in a groove formed in the outer surface of spool 5 and engage the inner surface of internal chamber 15 in order to prevent the escape of control fluid past seals 30 and 31. However seals 30 and/or 31 could also be many other types of conventional or future developed seals which would function as required by the present invention. It will be understood that internal chamber 15 is annular in nature between the internal wall of upper housing 2*a* and the outer wall of spool 5, and that fluid may freely flow all around spool 5 (thereby making the pressure equal) between upper seal 30 and lower seal 31. Spool 5 also has lower pressure surface 33 and upper pressure surface 32 formed on its lower end. Although the embodiment shown in the figures illustrates the pressure surfaces 32 and 33 formed on the lower end of spool 5, alternate embodiments could form the pressure surfaces elsewhere on spool 5. In FIG. 2, the area of lower pressure surface 33 is greater than the area of upper pressure surface 32 and in one embodiment, lower pressure surface 33 is approximately twice as large as the upper pressure surface 32 and may be more than twice as large in still further embodiments. However, this area difference may vary depending as desired operating parameters as explained below. Spool 5 also includes an internal passage or central bore 29 extending from the bottom to approximately the mid-level of spool 5. In the embodiment shown, central bore 29 does not extend though to the top of spool 5 and only need be sufficiently long to accommodate valve stem 10, but the exact length of central bore 29 could vary from embodiment to embodiment. Contiguous with central bore 29 and formed between bottom pressure surface 33 and the top cylinder flange 40 is void space 36 (see FIG. 2 insert). Spool 5 will also have a guide slot 34 which is engaged by alignment screw 23. Alignment screw 23 allows spool 5 move in the vertical direction, but prevents rotation of spool 5 within internal chamber 15.

Figure 3:
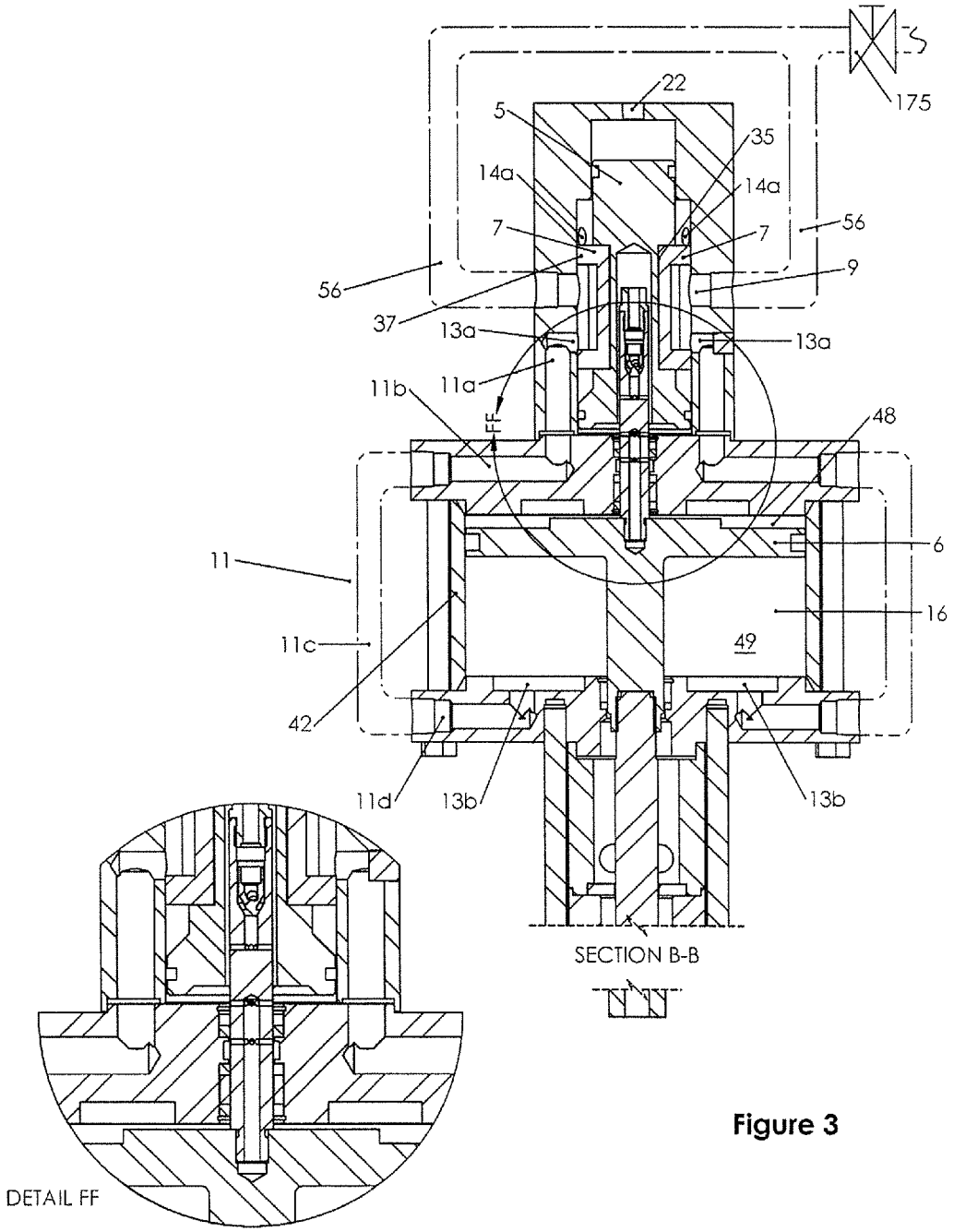
FIG. 3 is a cross-section along line B-B seen in FIG. 1B.

Spool 5 will further include a slide valve slot 35 (FIG. 3) for retaining slide valve 7. In FIG. 3, slide valve 7 is shown tightly fitting within slide valve slot 35. However, in other embodiments, slide valve slot 35 may be sized somewhat larger than slide valve 7 such as seen in U.S. Pat. No. 6,736,046 which is incorporated by reference herein in its entirety. In either instance, slide valve 7 should be considered as traveling with spool 5 as spool 5 moves up and down. The embodiment of slide valve 7 seen in FIG. 3 is formed by a "d-slide" which completely encloses an internal valve space 37 between the inner surface of slide valve 7 and the inner surface of upper chamber 15 covered by slide valve 7. This example of slide valve 7 has a curvature matching the internal curvature of internal chamber 15 and the slide valve 7 has an arc which sweeps about 120°. In the embodiment shown in the Figures, there are two slide valves 7, but other embodiments could contain just one slide valve 7 or possibly more than two slide valves 7. The smaller the arc, the more slide valves which may be accommodated. The drive mechanism size (i.e., housing and cylinder diameters) may also be parameters considered in the determination of slide valve arc length and number, since more slide valves enable greater control fluid flow rates. All such variations are within the scope of the present invention.

Figure 4:
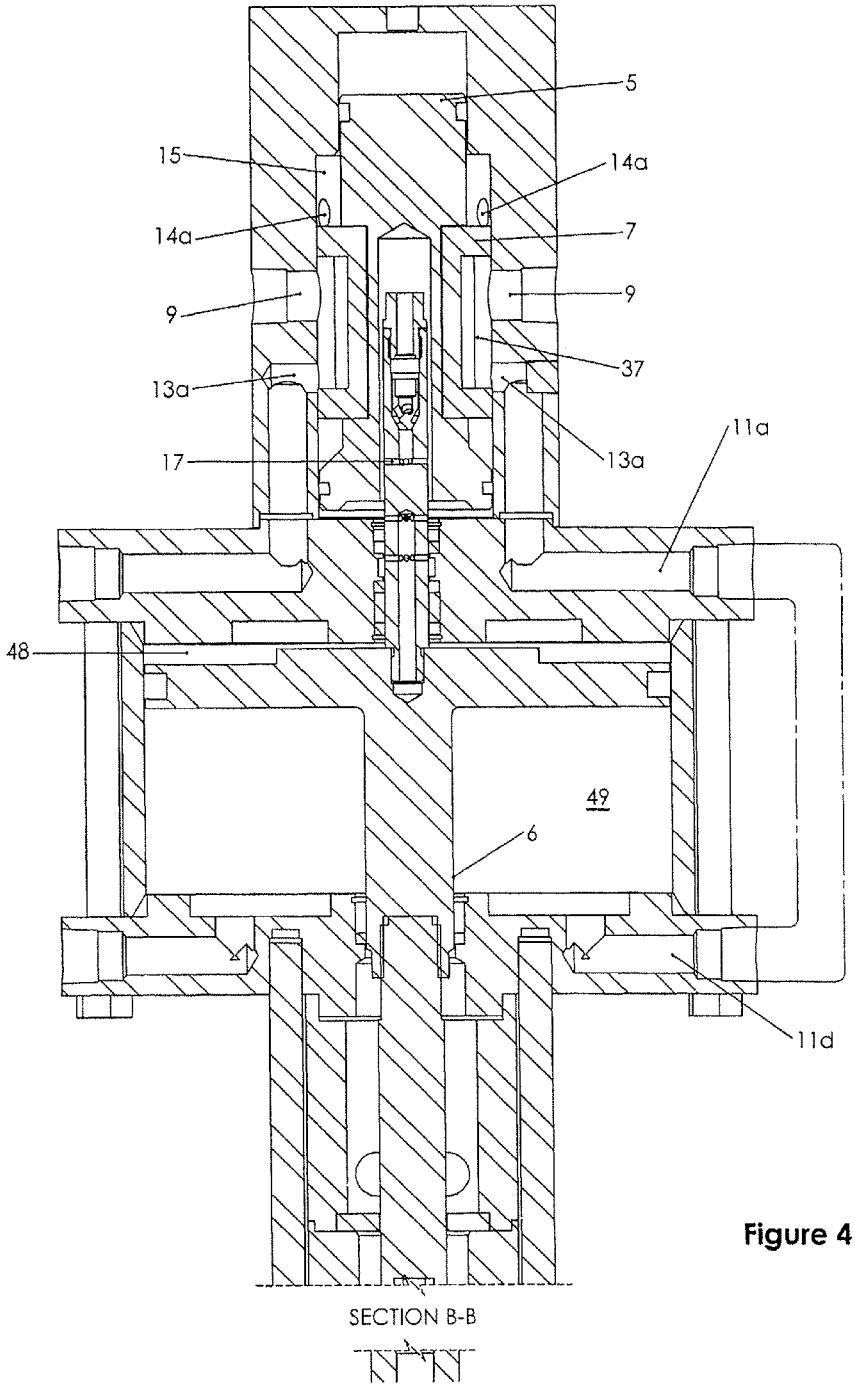
FIG. 4 is the same view as FIG. 3, but with the spool in the down position.
Figure 5:
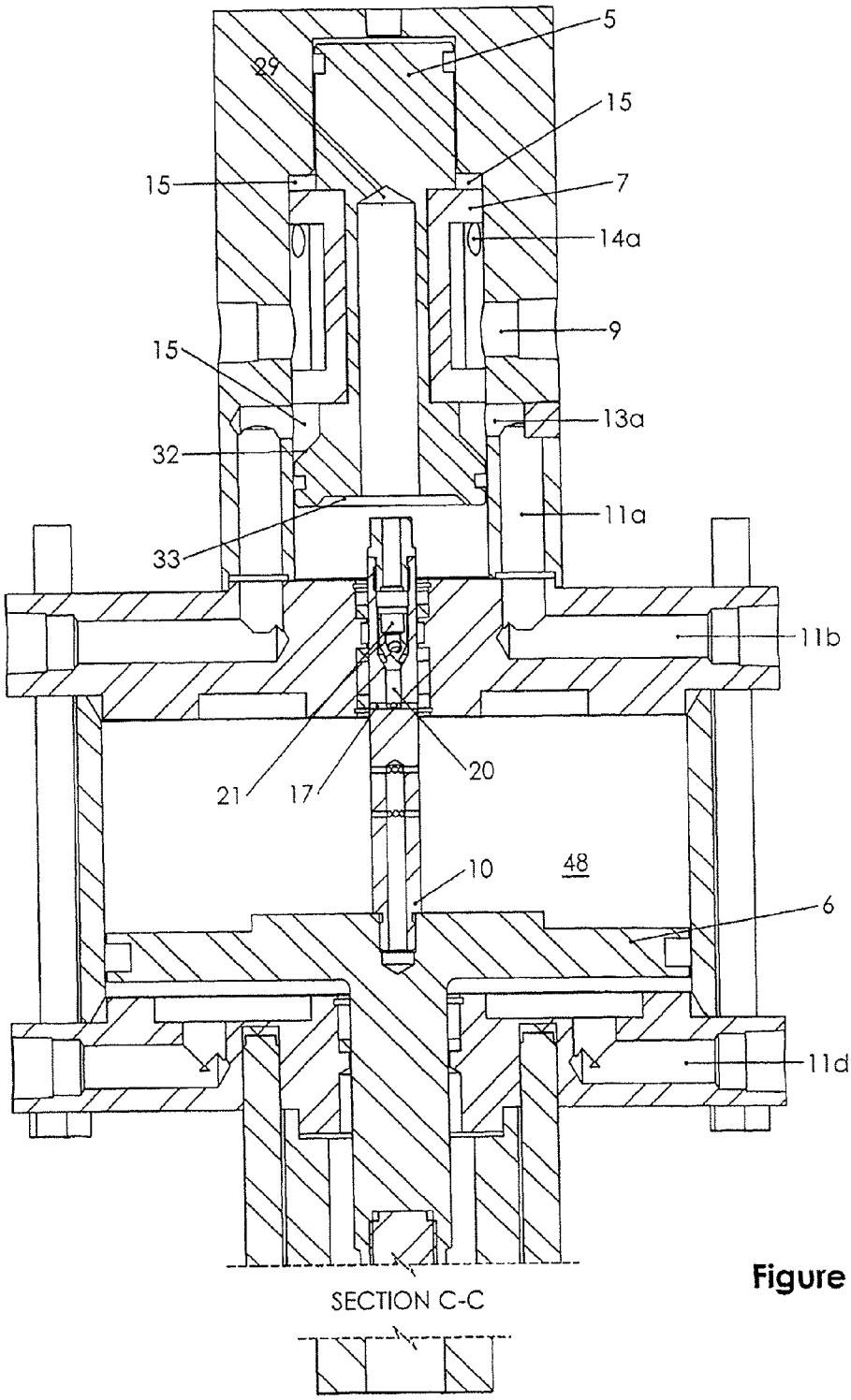
FIG. 5 is a cross-section along line C-C seen in FIG. 1C.

As will be explained in more detail below, slide valve 7 has a length which allows internal valve space 37 to cover exhaust port 9 and port 13*a* (but not block port 14*a*) while in the position seen in FIG. 4, and alternatively to cover exhaust port 9 and port 14*a* (but not block port 13*a*) while in the position seen in FIG. 3. Thus it can be seen that slide valve 7 partially interrupts the continuous annular space formed in upper chamber 15 between the inner side surface of housing 2A and the outer side surface of spool 5.

FIG. 3 also illustrates how port 13*a* communicates with fluid conduit 11 (shown in segments 11*a*-11*d*), which forms a continuous passage from upper internal chamber 15 to port 13*b*, which communicates with the lower cylinder space 49 (i.e., the portion of the cylinder space below piston 6) of lower internal chamber 16. In the particular embodiment of FIG. 3, conduit section 11*c* is formed by external lines connecting conduit sections 11*b* and 11*d*. However, alternative embodiments could form conduit section 11*c* as a passage through a flange fixed to the external surface of cylinder sidewall 42 or form a conduit in any manner which connects upper internal chamber 15 with lower cylinder space 49. Briefly turning to FIG. 7, a similar conduit 12 can be seen running from port 14*a* in upper internal chamber 15 to the port 14*b* opening to the upper cylinder space 48 (i.e., the portion above piston 6) of lower internal chamber 16. Conduit 12 may also be external or internal to the mechanism housing or some combination thereof. The ports 13*a* and 14*a* may be spaced or offset from one another along the internal circumference of upper internal chamber 15 as suggested by the section B-B seen in FIG. 3 (e.g., ports 13*a* are bisected by the cross-section cut while ports 14*a* are positioned further back along the internal wall of pilot valve housing 2*a*). In one exemplary embodiment, there are two passages 11 and four passages 12. However, the specific arrangement and number of passages 11 and 12 (and corresponding ports 13*a*/13*b* and 14*a*/14*b*) may vary depending on space available for forming passages in the walls of housing 2 or other relevant design considerations.

FIG. 2 illustrates how piston and cylinder assembly 4 generally comprises top cylinder flange 40, bottom flange 41, and cylinder side walls 42 with the assembly being secured together with cylinder bolts 45 to form lower internal chamber 16. The piston 6 is positioned in assembly 4 and is attached to piston rod 44, which in turn drives the reciprocating tool 100. A lower piston seal 60 prevents fluid from escaping where piston rod 44 moves through bottom flange 41.

FIG. 2 also illustrates the valve stem 10 attached to piston 6. The bottom portion of valve stem 10 will be fixed to piston 6 such that valve stem 10 moves up and down in conjunction with piston 6. As best seen in the detail of FIG. 2, valve stem 10 will pass through stem bore 47 formed in top cylinder flange 40. Stem bore 47 will further include annular slots to accommodate a series of sealing or packing elements such as upper packing 53 and lower packings 54 in order to prevent the leakage of operating fluids between stem bore 47 and valve stem 10. Packing elements 53 and 54 will be retained in the annular slots by snap rings 52. Stem bore 47 will also include an annular cavity 50 which communicates with vent conduit or passage 51 (and vent line 57) forming a second fluid exhaust path leading to exhaust line 56 (although in the alternative this exhaust path could vent to the atmosphere).

The detail of FIG. 2 further illustrates a series of passages formed in valve stem 10. A first side passage 17 is formed in valve stem 10 and communicates with a vertical passage 20 traveling to the top of valve stem 10. Although FIG. 2 shows first side passage 17 formed as a horizontal bore through valve stem 10, first side passage 17 could take on any number of different configurations as long as it communicates with vertical passage 20. Positioned within vertical passage 20 is a one-way valve 21 which allows fluid to flow up vertical passage 20 (i.e., from side passage 17 to the top of valve stem 10 in the upward direction indicated by arrow A), but prevents fluid flow in the opposite or downward direction (indicated by arrow B). Although many alternative types of one-way valves may be used, the embodiment shown in FIG. 2 employs a poppet valve similar to that seen in U.S. Pat. No. 6,736,046 as the one-way valve 21. However, depending on the pressure of the control fluid and other operating conditions, a "rod ball" valve device, a vent opening or other one-way valve configurations may be an acceptable substitution for the "poppet." Positioned below side passage 17 is a second side passage formed by side bores 18 and 19 drilled into valve stem 10 and connected within valve stem 10 by vertical bore 65. As will become more apparent with the description of the reciprocating drive mechanism's operation below, the distance between first passage 17 and the second passage beginning at bore 18 is linearly related to the stroke length of piston 6. The greater or shorter the distance between side passage 17 and side bore 18, the greater or shorter respectively is the stroke length of piston 6. In the embodiment of FIG. 2, side bores 18 and 19 are connected by vertical bore 65 such that fluid may flow between the two side bores. In this example, several horizontal bores 18 and 19 are made through valve stem 10 and vertical bore 65 connects bores 18 and 19 in order to form the second passage. In the example of FIG. 2, vertical bore 65 has been drilled through the bottom of valve stem 10 for ease of manufacturing.

Figure 8A:
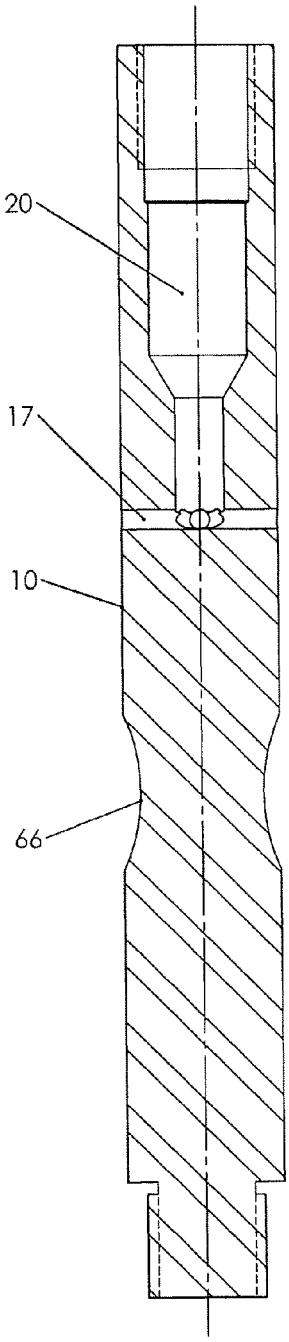
FIGS. 8A and 8B illustrate alternative valve stem passages.
Figure 8B:
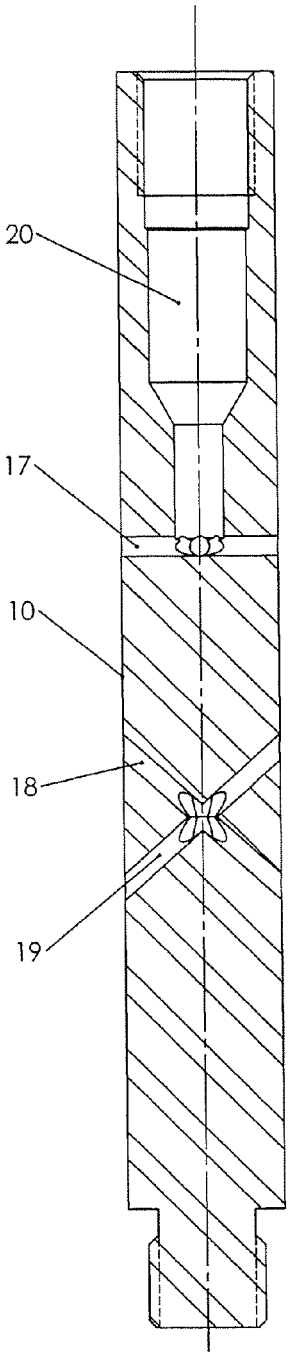

As additional nonlimiting examples, FIGS. 8A and 8B illustrate alternative embodiments for valve stem 10. In FIG. 8A, a second side passage 66 is formed in place of the second and third side bores 18 and 19 previously described. Second side passage 66 may be any indention in valve stem 10 shaped to bridge the seal 53 (i.e., allow air to flow between annular cavity 50 and void space 36) in the same manner as the V-shape of bores 18 and 19 seen in FIG. 2. In FIG. 8A, the indention forming side passage 66 is formed around the entire circumference of valve stem 10. However, other embodiments could form the indention on only part of valve stem 10's circumference, thereby adjusting the area of passage 66 through which fluid could flow.

FIG. 8B illustrates an alternative embodiment of valve stem 10 similar to that in FIGS. 1 to 7. In this embodiment, each of side bores 18 and 19 are V-shaped and extend through valve stem 10 to opposite sides. Although side bores 18 and 19 in the embodiment of FIG. 8B each have two openings on valve stem 10 and meet at the tips of their V-shapes in order to form an X-shaped configuration, many other configurations of side bores 18 and 19 are possible. Side bores 18 and 19 do not need to be slanted and do not need to communicate with two (or more) sides of valve stem 10, although most embodiments of side bores 18 and 19 will have a vertical distance between them and the two side bores will communicate with one another within valve stem 10. Although the drawings illustrate only three different embodiments of the second side passage, it will be understood that the present invention encompasses all manners of forming a passage on or through valve stem 10 to allow for the movement of fluid as needed in order for the valve to operate as contemplated. In the embodiment of FIG. 2, the vertical distance between side bores 18 and 19 is too short to allow communication between annular space 50 and the upper cylinder space 48 (i.e., the space formed between the bottom of top flange 40 and the top of piston 6). On the other hand, the vertical distance between side bores 18 and 19 is sufficiently long to allow communication between annular space 50 and void space 36 in upper internal chamber 15. For convenience of explanation herein, side passage 17 with bore 20 may sometimes be referred to as a "first" passage while bores 18 and 19 maybe referred to as a "second" passage, but this should not be understood as a particular limitation in how the side passages may be arranged in the many possible alternative embodiments (i.e., FIG. 8A), or that there could not be additional passages beyond those shown in the Figures.

Operation Of Illustrated Embodiment

The operation of the reciprocating drive mechanism may be described with continued reference to the Figures. As further described below, slide valves 7 are slideably shiftable in upper internal chamber 15 between a first position and a second position by means of pressure applied by control fluid supplied to upper internal chamber 15 through fluid inlet 8. The movement of slide valve 7 between a first position and a second position further controls the communication of control fluid to either the upper cylinder space 48 or the lower cylinder space 49 in lower internal chamber 16 to drive the piston 6 between an upper and lower position. In this manner, reciprocating device 100 achieves a consistent cyclic rate.

This operation may be understood with reference to the sequence of figures described below. FIG. 4 shows piston 6 traveling downward and spool 5 in the downward position. Because spool 5 and thus slide valves 7 are in the lower position, slide valves 7 cover and connect exhaust ports 9 and ports 13*a*. As piston 6 travels downward, fluid in lower cylinder space 49 escapes through fluid conduit 11 into the internal valve space 37 of slide valve 7, and out of fluid exhaust 9. Likewise, operating fluid entering upper internal chamber 15 through inlet 8 is able to enter ports 14*a* and upper cylinder space 48 via fluid conduits 12 (hidden from view in FIG. 4 but seen in the section of FIG. 7). It can be understood that backpressure valve 175 (FIG. 3) is capable of controlling the rate of downward movement of piston 6 by restricting the rate at which fluid may escape lower cylinder space 49. At the point of operation seen in FIG. 4, the side passage 17 on valve stem 10 has not yet entered upper cylinder space 48.

Figure 6:
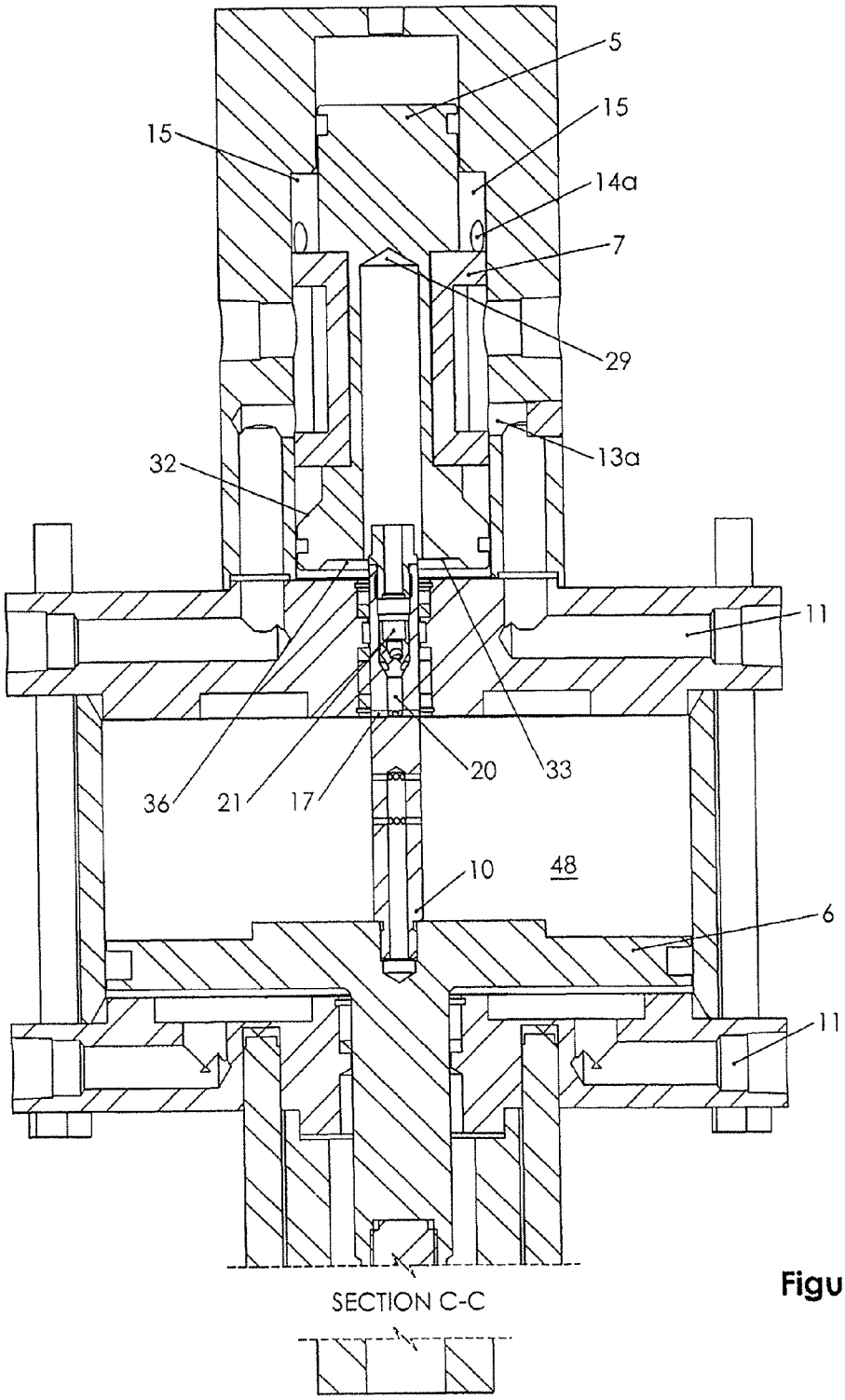
FIG. 6 is the same view as FIG. 5, but with the spool in the down position.
Figure 7:
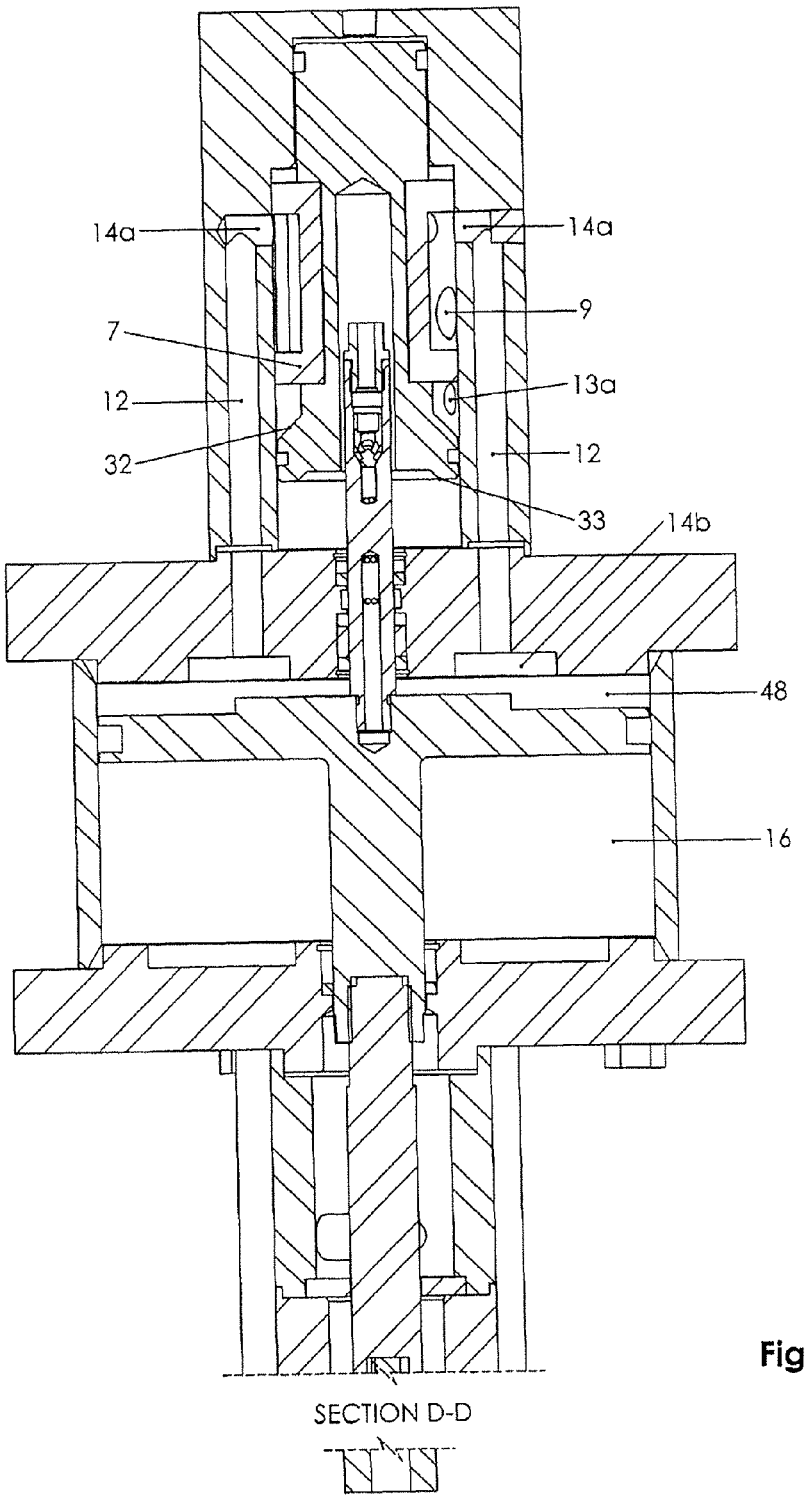
FIG. 7 is a cross-section along line D-D seen in FIG. 1D.

Next viewing FIG. 6, piston 6 has traveled to its lowest position and side passage 17 on valve stem 10 is just entering upper cylinder space 48. The pressurized fluid in upper cylinder space 48 travels through side passages 17, vertical passage 20, and one-way valve 21 to act on the upper inside surface of spool bore 29 and spool lower pressure surface 33. Because this surface area is greater than spool upper pressure surface 32 (with the pressure in upper chamber 15 and void space 36 being approximately equal at this point), spool 5 moves to the upward position seen in FIG. 5. Along with spool 5, slide valves 7 move to their upward position, thus covering and connecting ports 14*a* and exhaust ports 9. Likewise, ports 13*a* are now exposed to the pressurized fluid in upper internal chamber 15. Therefore, pressurized fluid moves to the area below piston 6 via passages 11 while fluid in upper cylinder chamber 48 is forced through passages 12 (FIG. 7) and escapes through exhaust ports 9 as piston 6 begins to rise. Thereafter, piston 6 will continue to move upward until in a position seen in FIG. 2. Naturally, backpressure valve 175 has the same control effect on piston 6 when fluid is exhausted from upper cylinder space 48. From the foregoing, it can be seen how the difference in area of upper and lower pressure surfaces 32/33 is a factor in controlling how rapidly spool 5 changes positions and switches which of upper or lower cylinder spaces 48/49 is vented to the exhaust.

As piston 6 pushes valve stem 10 upward to the position of FIG. 2, side bore 18 will encounter void space 36. Although the detail of FIG. 2 shows side passage 18 at the level of snap ring 52, it will be understood that fluid in space 36 may readily flow around snap ring 52 into side bore 18. Because the vertical distance between side bores 18 and 19 is spaced to allow communication between void space 36 and annular space 50, pressurized fluid in void space 36 is allowed to escape via annular space 50 and vent passage 51. At this point, with no pressurized fluid in void space 36, the pressurized fluid in upper internal chamber 15 acting on upper pressure surface 32 drives spool 5 to the downward position. Once again, slide valves 7 connect ports 13*a* with fluid exhausts 9 (as in FIG. 4) and pressurized fluid in lower cylinder space 49 may travel through passages 11 and out fluid exhausts 9. Likewise, pressurized fluid in upper internal chamber 15 now enters ports 14*a* and travels via passages 12 to upper cylinder space 48 and begins moving piston 6 downward to the position of FIG. 6, as the above described process begins again.

An alternate embodiment of the present invention is seen in FIGS. 9A to 9D. For simplicity, several elements such as spool 5, slide valves 7, and valve stem 10 are omitted and only the housing is shown. However, it will be understood that in the completed mechanism, these elements would be present and function either as described above, or as seen in other mechanisms (nonlimiting examples of which include the spool, slide valves, etc. seen in U.S. Pat. Nos. 6,736,046, 5,468,127 and/or 4,776,773, which are incorporated by reference herein in their entirety).

Rather than two separate housings as shown in the previous embodiments, the FIG. 9 embodiment is created from a single section of material forming a unitary housing 75. In some embodiments, this unitary housing could include a single, uniform section of material. In other embodiments, a "unitary" housing could include multiple sections of material fixed together in various manners, including welding, threaded engagement, etc. In one embodiment, the material is hard anodized aluminum, but those skilled in the art will recognize enumerable other materials, including rigid plastic materials, steels, and/or base materials with coatings that may be suitable depending on the use and environment of the drive mechanism. In preferred plastic embodiments, the material will exhibit good abrasion resistance, high strength, little or no cold flow, and good resistance to UV and chemical attack. Non-limiting examples of such plastics could include UHMWPE, Delrin, polypropylene, Torlon, PEEK, PEI, and PVC. FIG. 9A is a top view illustrating the spacing of fluid inlet 8, fluid exhausts 9, and the position of passages 11 and 12 leading to ports 13*a* and 14*a*.

Figure 9A:
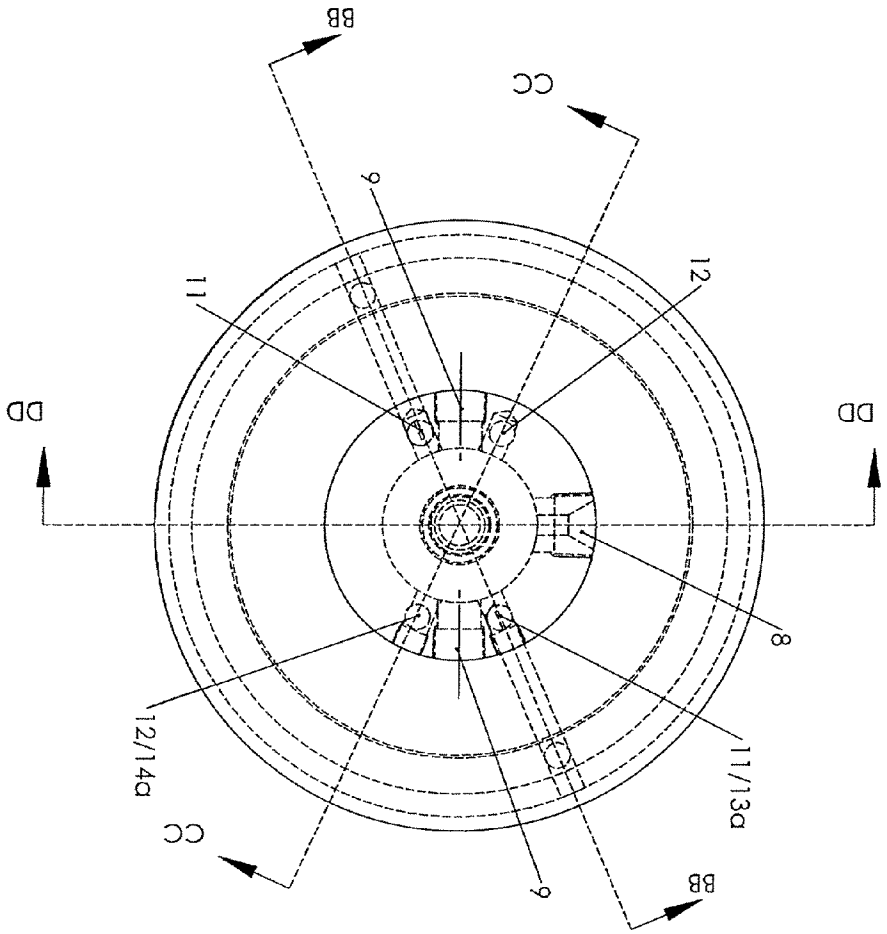
FIGS. 9A to 9D illustrate a still further alternative embodiment.
Figure 9B:
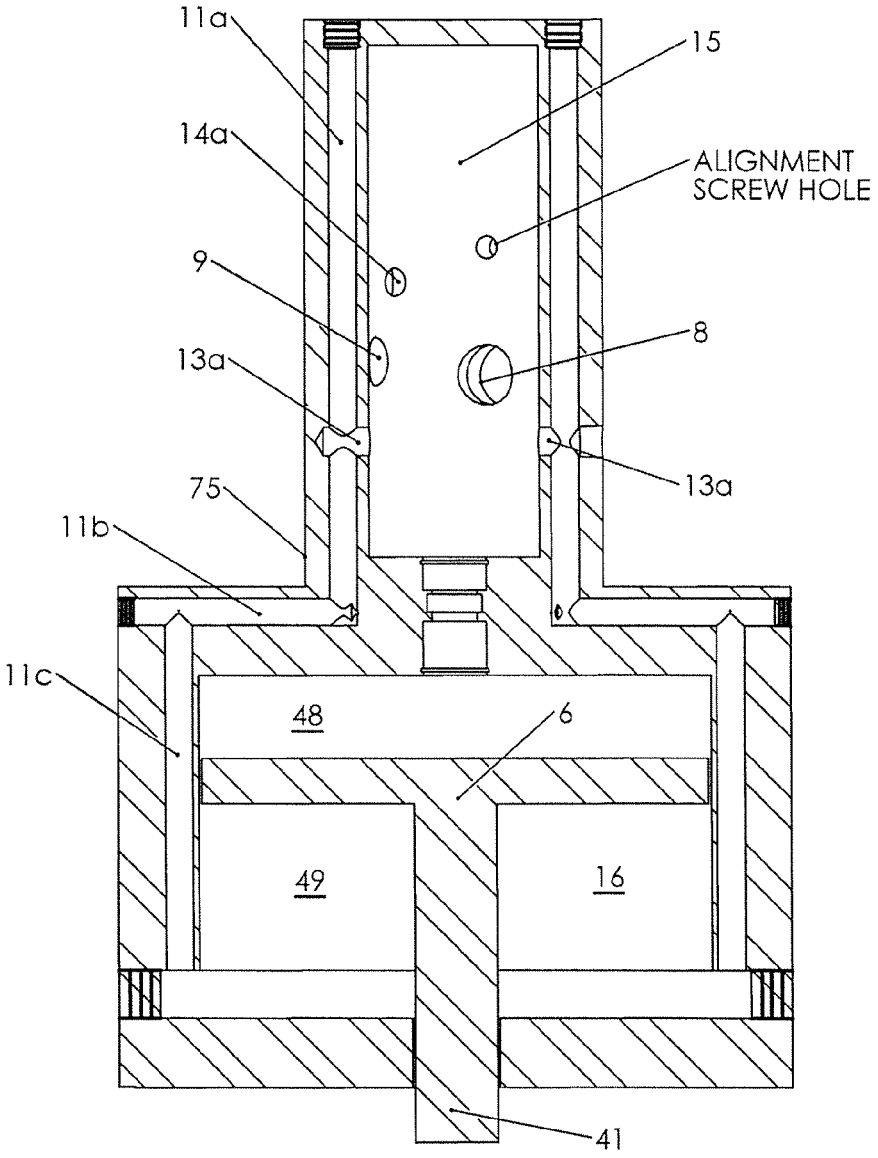
Figure 9C:
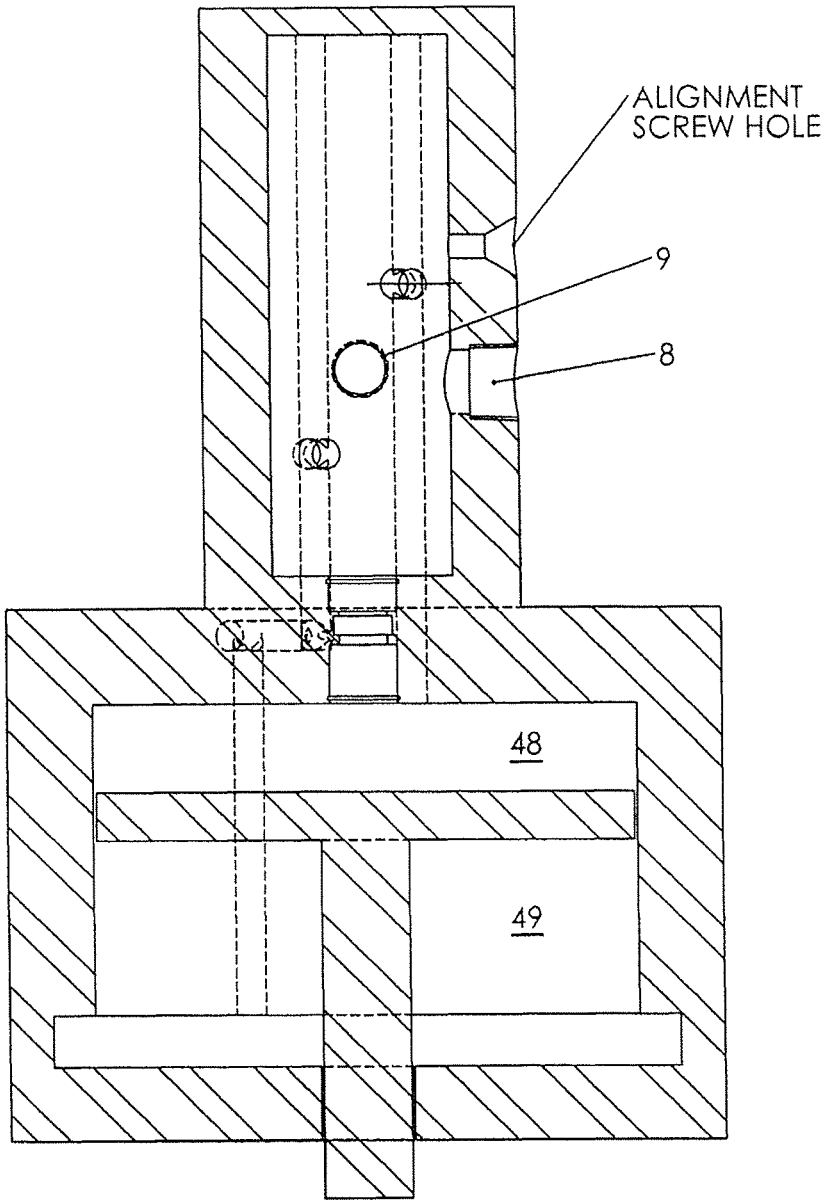
Figure 9D:
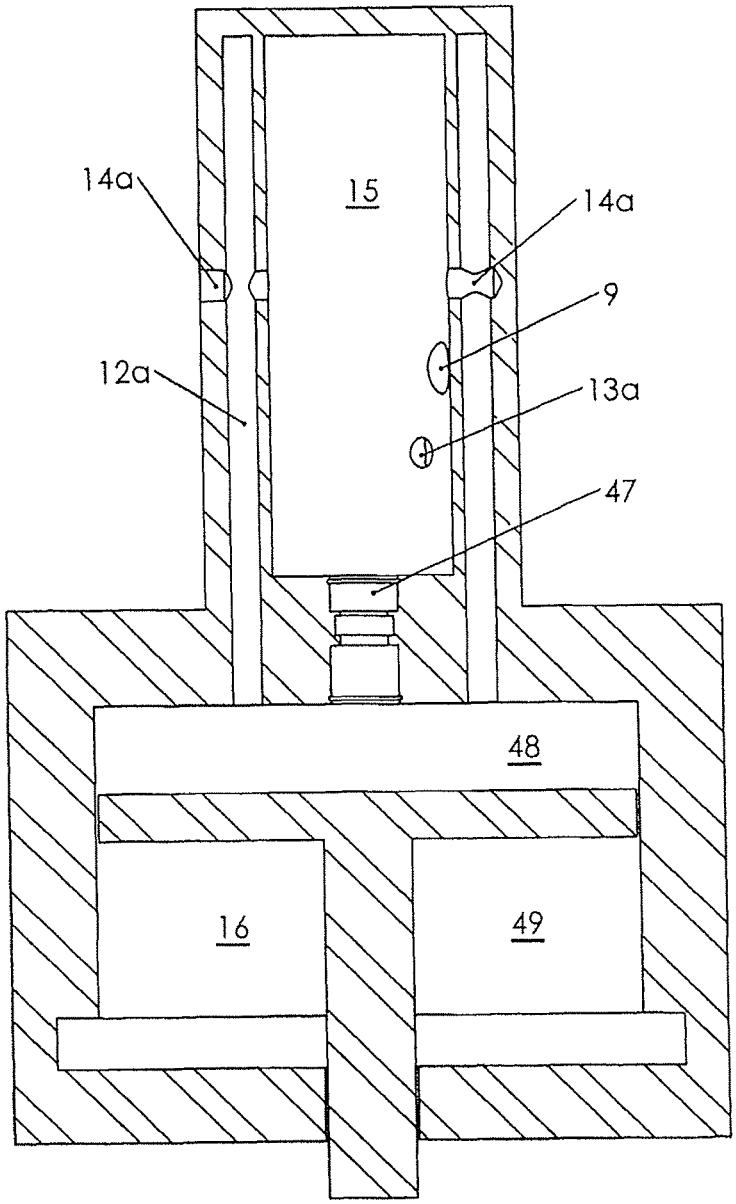

FIG. 9B is a section along line B-B showing the path of passage or conduit 11, which may be referred to as "lower chamber conduit" because it travels from upper internal chamber 15 to the lower cylinder chamber 49. FIG. 9D is a section along line C-C showing the path of passage or conduit 12, which may be referred to as "upper chamber conduit" because it travels from upper internal chamber 15 to the upper cylinder chamber 48. Also shown in FIG. 9B is a screw hole to accommodate an alignment screw (such as alignment screw 23 seen in FIG. 2).

As best seen in FIGS. 9A and 9B, in this embodiment the fluid inlet(s) 8, the fluid exhaust(s) 9, port(s) 14*a* (for the upper chamber conduits), and the port(s) 13*a* (for the lower chamber conduits) are all angularly offset from one another (i.e., are spaced apart from one another along the inner circumference of internal chamber 15). This allows for upper chamber conduits 12 and lower chamber conduits 11 to be formed through the side walls of unitary housing 75, thereby eliminating the need for the external tubing described in the previous embodiments. FIG. 9B illustrates the various ports 13*a*/14*a*, inlets 8, and exhausts 9 as being vertically spaced apart as well as angularly offset. However, other embodiments could form the ports, inlets, and exhausts on the same vertical level (i.e., all in the same horizontal line).

The present invention also includes a method of constructing the housing 75 seen in FIGS. 9A to 9B. The method begins with providing a unitary section of material. In the example of FIGS. 9A and 9B, the section of material has the shape of two solid cylinders joined at one of their ends, but the section of material could take on other shapes in other embodiments. One of the cylinders has an outside diameter larger than the other, but a difference in outside diameters between the cylinders is not necessary in all embodiments, and it is mainly advantageous for weight minimization.

An upper internal chamber 15 is bored into the upper (smaller diameter) solid cylinder and a larger diameter lower internal chamber 16 is bored in the lower solid cylinder portion. A stem bore 47 is formed between the upper and lower internal chambers 15 and 16. In the embodiment of FIG. 9D, the stem bore 47 has an insert to form the proper spacing for packing, retaining rings, etc. Then a first vertical passage or conduit 12*a* (FIG. 9D) is bored through a sidewall of the upper internal chamber 15 and into the upper cylinder chamber 48.

A second vertical passage or conduit 1 la (FIG. 9B) is bored through a sidewall of the upper internal chamber 15 at a position angularly offset from conduit(s) 12*a* (and inlet(s) 8 and exhaust(s) 9). A third vertical passage or conduit 11*c* is bored through a sidewall of the lower internal chamber 16. Finally, the horizontal passage or conduit 11*b* is bored such that conduits 11*a* and 11*c* are connected. Thereafter, a bottom flange 41 may be positioned over the lower end of housing 75 and outer openings of the various drill bores may be capped to provide the configuration illustrated. Although the embodiment of FIG. 9 illustrate a valve with offset passages formed in this manner from a unitary section of material, other embodiments could employ the offset passage concept in valves formed of multiple housing pieces such as in FIGS. 1-7.

Although the above description is in terms of selected embodiments, the present invention may include many modifications and variations of the present figures. For example, although FIG. 2 shows the reciprocating drive mechanism 1 configured to drive a single reciprocating device 100, it can be appreciated by one of ordinary skill in the art that multiple reciprocating devices 100 could be driven by the present invention in alternative embodiments. For example, additional reciprocating devices 100 could be cascaded below the piston and cylinder assembly 4 with each drawing its motion from the movement of piston 6 and piston rod 44. Each reciprocating device 100 would be mechanically coupled in some fashion to piston rod 44. Furthermore, a reciprocating device 100 could be located at other positions relative to pilot control valve 3 (i.e., above or to the side) and driven in accordance with the present invention by extending the motion of piston rod 44 by some type of mechanical coupling or linkage and such motion could be synchronized with the motion of other reciprocating devices 100 positioned around pilot control valve 3. Likewise, the embodiments described in the above figures have many advantages over prior art devices such as requiring fewer seals, providing a more reliable switching system, and allowing for greater ease in adjusting stroke length. For example, in U.S. Pat. No. 6,736,046, adjustment of stroke length requires a different size pilot valve housing. On the other hand, selected embodiments of the present invention allow adjustment of stroke length merely by altering the distance between side passages in the valve stem. This allows for the use of a smaller, single pilot valve housing while providing greater versatility in stroke length. However, none of these advantages are necessarily critical to any particular embodiment and other embodiments not having such advantages are intended to fall within the scope of the present invention. All obvious modifications and variations of the embodiments described above are intended to come within the scope of the following claims.

We claim:

1. A method of manufacturing a housing for a reciprocating mechanism comprising the steps of:

a. providing a unitary section of material;

b. boring an upper internal chamber in an upper portion of said material and a larger, lower internal chamber in a lower portion of said material;

c. boring a first substantially vertical passage through a sidewall of said upper internal chamber and into said lower internal chamber;

d. boring a second substantially vertical passage through a sidewall of said upper internal chamber;

e. boring a third substantially vertical passage through a sidewall of said lower internal chamber; and f. boring a fourth substantially horizontal passage connecting said second and third vertical passages.

2. The method of claim 1, wherein said section of material is metal and has an upper solid cylinder of one diameter and a lower solid cylinder of a second, larger diameter.

3. The method of claim 1, wherein said section of material is plastic.

4. The method of claim 1, wherein said upper internal chamber communicates with a fluid inlet, a fluid exhaust, an upper chamber conduit, and a lower chamber conduit, and at least three of said fluid inlet, fluid exhaust, upper chamber conduit, and lower chamber conduit are angularly offset from one another.

5. The method of claim 1, further comprising the steps of providing:

g. a valve stem having a bore communicating with said upper internal chamber;

h. an exhaust passage positioned between said upper and lower internal chambers;

i. a first side passage formed on said valve stem and connecting to said bore in said valve stem; and j. a second side passage formed in said valve stem below said first passage and shaped to bridge a seal positioned between said exhaust passage and said upper internal chamber.

6. A method of manufacturing a housing for a reciprocating mechanism comprising the steps of:

a. providing a unitary section of material;

b. boring an upper internal chamber in an upper portion of said material and a larger, lower internal chamber in a lower portion of said material;

c. boring a first substantially vertical passage through a sidewall of said upper internal chamber and into said lower internal chamber;

d. boring a second substantially vertical passage through a sidewall of said upper internal chamber;

e. boring a third substantially vertical passage through a sidewall of said lower internal chamber;

f. boring a fourth substantially horizontal passage connecting said second and third vertical passages; and g. providing a spool slidably positioned inside said upper internal chamber, said spool comprising a length and an internal passage opening at a bottom of said spool, said internal passage being less than said length of said spool.

7. The method of claim 6, further comprising the step of providing a space in said upper internal chamber above said spool and maintaining said space at a pressure less than a pressure at said fluid inlet.

8. The method of claim 1, further comprising the steps of positioning a spool in the upper internal chamber and a piston in the lower internal chamber.

* * * * *